US005097998A

United States Patent [19]

Shimasaki

[11] Patent Number: 5,097,998

[45] Date of Patent: Mar. 24, 1992

[54] TOILETTE PAPER DISPENSER

[76] Inventor: Alan Shimasaki, 8035 Shadow Hill Dr., La Mesa, Calif. 92041

[21] Appl. No.: 412,195

[22] Filed: Sep. 25, 1989

Related U.S. Application Data

[63] Continuation-in-part of Ser. No. 348,388, May 8, 1989, abandoned.

[51] Int. Cl.[5] ..... B26F 3/02; B65D 85/671

[52] U.S. Cl. ..... 225/106; 206/390

[58] Field of Search ..... 225/1, 39, 51, 106, 225/52, 49, 54; 221/63, 55; 242/55.53, 55.54, 55.2, 55.3; 206/391, 394, 390, 494, 409, 412

[56] References Cited

U.S. PATENT DOCUMENTS

| | | | |
|---|---|---|---|
| 2,806,591 | 9/1957 | Appleton | 206/58 |
| 2,834,646 | 5/1958 | Berg | 225/51 |
| 2,850,157 | 9/1958 | Klein et al. | 225/51 X |
| 2,890,822 | 6/1959 | Lee et al. | 225/51 |
| 3,150,808 | 9/1964 | Vensel | 225/106 |
| 3,235,196 | 2/1966 | Platt | 242/55.53 |
| 3,432,081 | 3/1969 | Forte | 225/39 |
| 3,523,653 | 8/1970 | Hansen | 242/55.53 |
| 3,749,296 | 7/1973 | Harrison | 225/106 |
| 3,868,052 | 2/1975 | Rockefeller | 225/106 |
| 4,180,160 | 12/1979 | Ogawa et al. | 225/106 X |
| 4,262,816 | 4/1981 | Margulies | 221/46 |
| 4,289,262 | 9/1981 | Finkelstein | 225/106 |
| 4,659,028 | 4/1987 | Wren | 242/55.53 |
| 4,863,027 | 9/1989 | Yano | 206/390 |

*Primary Examiner*—Frank T. Yost
*Assistant Examiner*—Rinaldi Rada
*Attorney, Agent, or Firm*—Lynn & Lynn

[57] ABSTRACT

A rolled paper dispenser comprises a receptacle configured to hold a roll of paper. The receptacle includes a base, side walls and a top. The top has an opening formed therein so that the free end of the roll of paper may extend out of the receptacle. The dispenser may include means for guiding the paper toward the opening in the top of the receptacle, and means spaced apart from the opening in which a user may engage the paper to tear off a selected length of the paper from the roll. The rolled paper dispenser may be formed a rectangular box or it may include a tapered section formed in the top of the receptacle for guiding the paper toward the opening in the top of the receptacle. The dispenser may includes at least one slot formed in the dispensing section so that a user may engage the paper in the slot to tear off a selected length of the paper from the roll. Instead of a slot, the dispenser may include one or more posts or hooks with which the paper may be engaged to facilitate tearing off a selected length.

1 Claim, 3 Drawing Sheets

FIG. 8
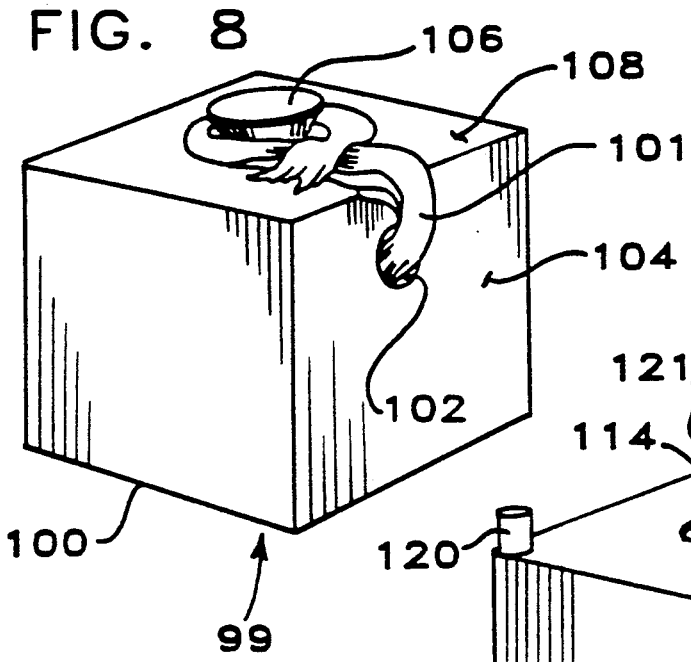
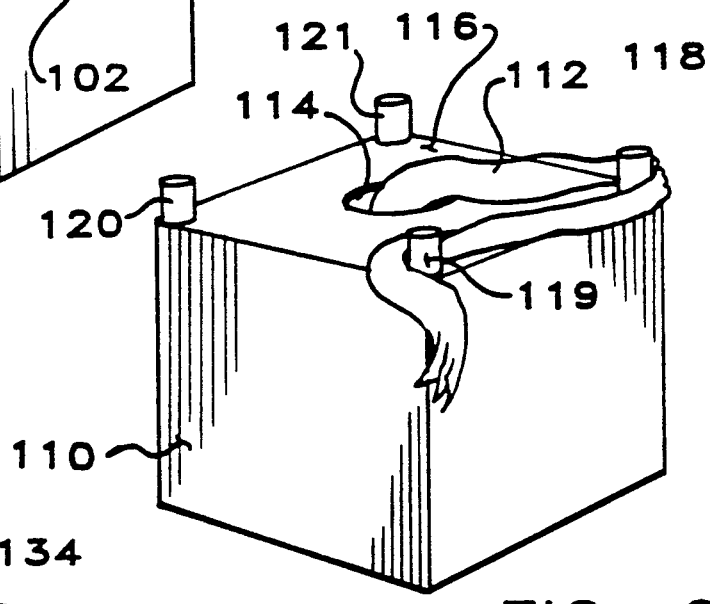
FIG. 9
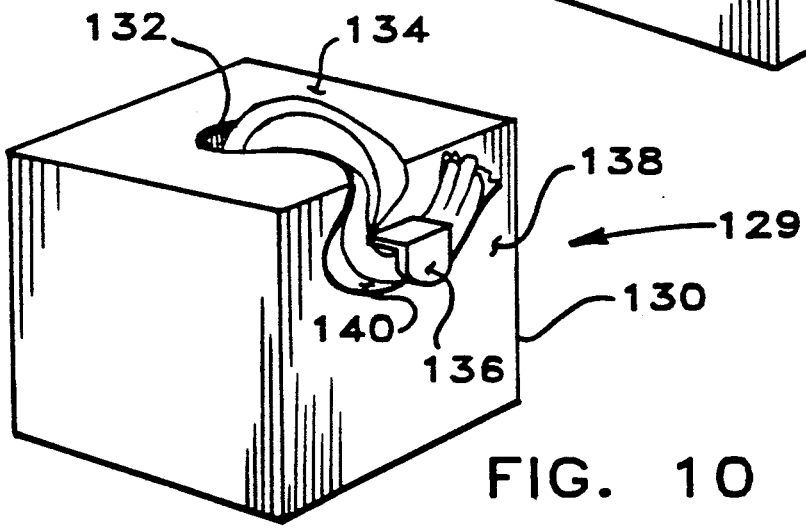
FIG. 10

TOILETTE PAPER DISPENSER

BACKGROUND OF THE INVENTION

This is a continuation-in-part of applicant's copending application Ser. No. 348.388 filed May 8, 1989, now abandoned.

This invention relates generally to apparatus and methods for dispensing tissue paper. The invention relates particularly to apparatus and methods for dispensing rolled tissue paper.

Toilette tissue is generally available in continuous, periodically perforated rolls. Paper of the same generally quality as toilette tissue is available in boxes of stacked interleaved sheets arranged so that pulling one sheet from the box pulls an edge of the next sheet in the stack from the box. The interleaved sheet form of tissue paper is generally more expensive than the rolled form. There is a need for apparatus for dispensing rolled paper to make the use of rolled paper as convenient as the interleaved sheets.

There are several known portable devices for dispensing rolled tissue paper. Examples of known devices are shown in U.S. Pat. Nos. 2,806,591 to Appleton; 3,235.196 to Platt; 3,523,653 to Hansen; 4,289,262 to Finkelstein; and 4,659,028 to Wren.

SUMMARY OF THE INVENTION

The present invention provides an inexpensive rolled paper dispenser that makes it easy to use rolled paper instead of interleaved sheets. A rolled pape dispenser according to the present invention comprises a receptacle configured to hold a roll of paper. The receptacle includes a base, side walls and a top. The top has an opening formed therein so that the free end of the roll of paper may extend out of the receptacle. The dispenser further includes a dispensing section connected to the receptacle. The dispensing section includes means for guiding the paper toward the opening in the top of the receptacle, and means spaced apart from the opening in which a user may engage the paper to tear off a selected length of the paper from the roll.

The rolled paper dispenser preferably includes a tapered section formed in the top of the receptacle for guiding the paper toward the opening in the top of the receptacle. The dispenser preferably includes at least one slot formed in the dispensing section so that a user may engage the paper in the slot to tear off a selected length of the paper from the roll.

The rolled paper dispenser may include extensions of the sides of the receptacle and a plurality of slots formed in the extended portions of the sides spaced apart from the opening so that a user may engage the paper in a selected one of the slots to tear off a selected length of the paper from the roll.

The invention may include a receptacle having generally rectangular surfaces with an opening formed one side so that an end of the roll of paper may extend out of the receptacle. A post or hook spaced apart from the opening provides means with which a user may engage the paper to tear off a selected length of the paper from the roll.

BRIEF DESCRIPTION OF THE DRAWINGS

FIG. 8 is a perspective view of a third embodiment of the invention;

FIG. 9 is a perspective view of a fourth embodiment of the invention; and

FIG. 10 is a perspective view of a fifth embodiment of the invention.

DESCRIPTION OF THE PREFERRED EMBODIMENT

Figure 1:
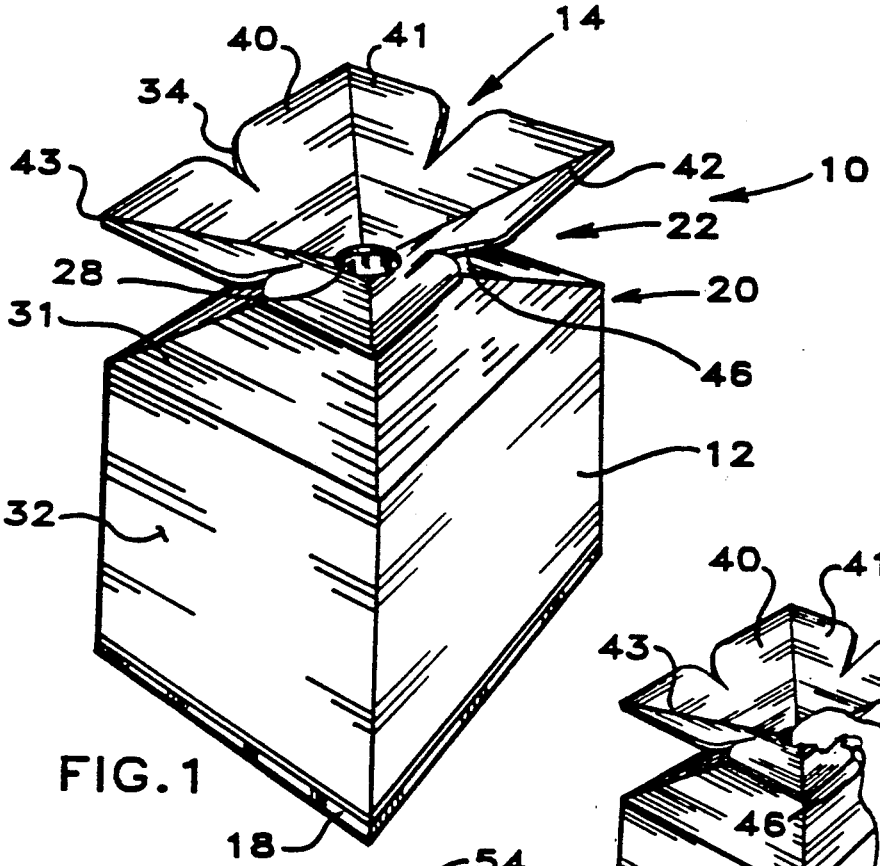
FIG. 1 is a perspective view of a tissue paper dispenser according to the present invention.
Figure 3:
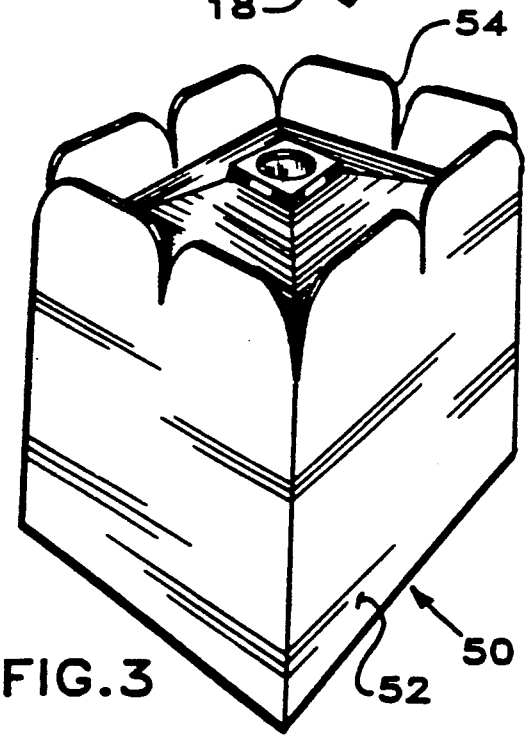
FIG. 3 is a perspective view of a second embodiment of a tissue paper dispenser according to the present invention.
Figure 2:
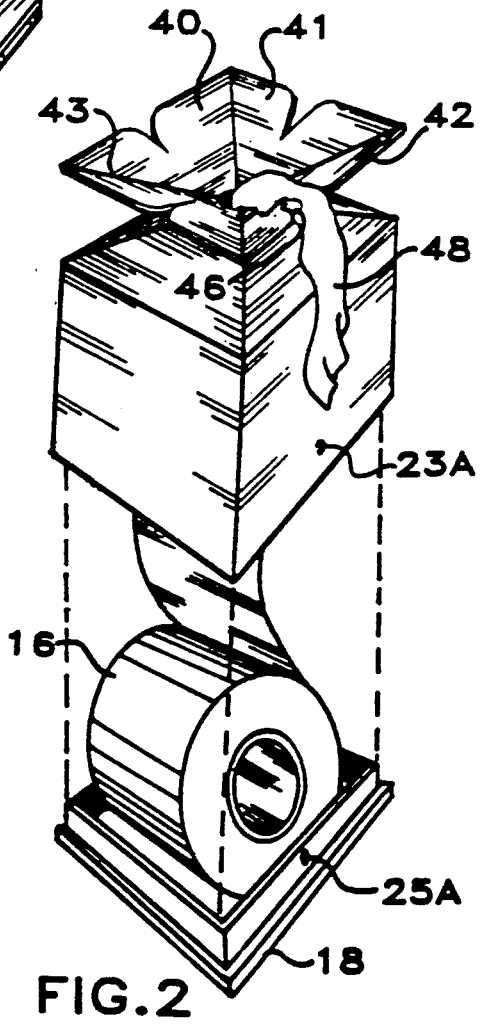
FIG. 2 is an exploded perspective view of the tissue paper dispenser of FIG. 1.
Figure 4:
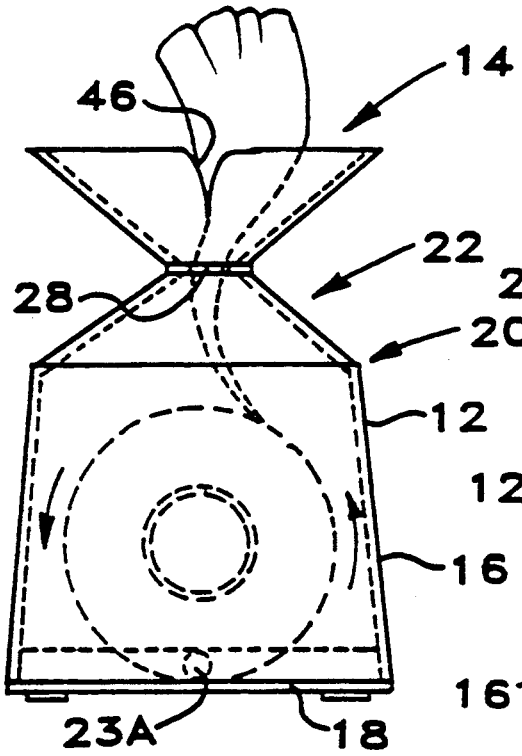
FIG. 4 is a front elevation view of the tissue paper dispenser of FIGS. 1 and 2.

Referring to FIG. 1, a tissue paper dispenser 10 includes a receptacle 12 and a dispensing section 14. The receptacle 12 may be any convenient shape for holding a roll of tissue paper 16 as shown in FIG. 2. As illustrated in FIGS. 1–5, the receptacle 12 is preferably a generally rectangular box having a detachable base 18. Referring to FIGS. 1, and 3–5, the receptacle 12 may have sidewalls that taper inward so that the upper portion 20 of the receptacle 12 is smaller in area than the base 18. As shown in FIGS. 3 and 4, the receptacle 12 is preferably formed to hold a full roll of toilett paper 16 on its side, which facilitates the dispensing of paper from the roll.

Figure 5:
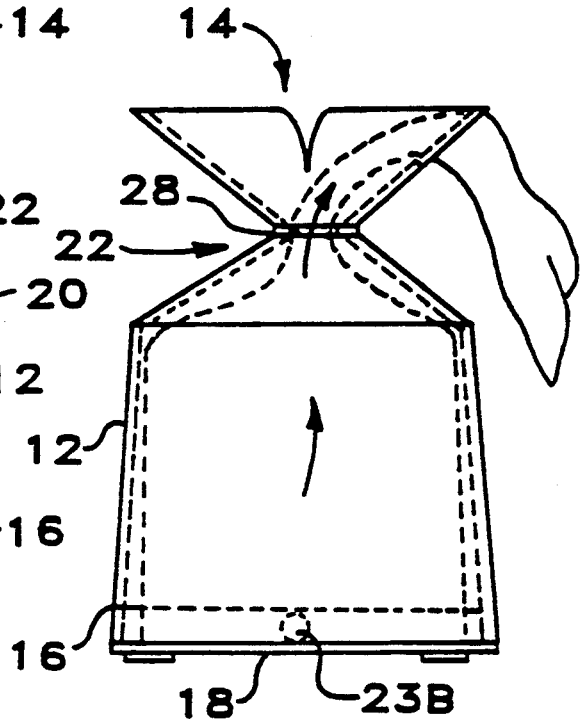
FIG. 5 is a back elevation view of the tissue paper dispenser of FIGS. 1 and 2.
Figure 6:
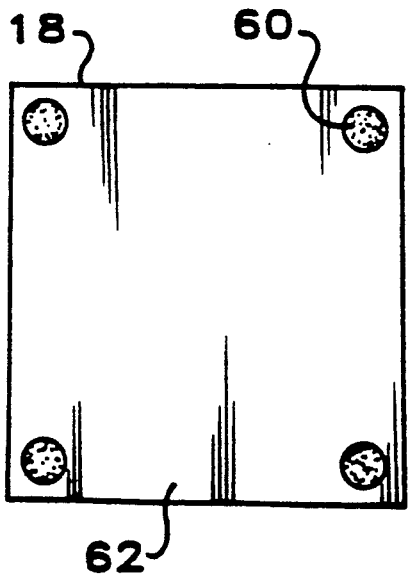
FIG. 6 is a bottom plan view of the tissue paper dispenser of FIGS. 1 and 2.

Referring to FIGS. 2, 4 and 5, the receptacle 12 may include a detent 23A that projects into a corresponding recess 25A formed in the front of the base 18. Referring to FIG. 5, a detent 23B may also be formed the receptacle 12 to project into a recess (not shown) formed in the back of the base 18. The detents and recesses cooperate to maintain a connection between the base 18 and the receptacle 12 under normal use. However, the material of the receptacle 12 is sufficiently flexible that the base 18 and the receptacle 12 may be separated by gripping the edges of the base and pulling it away from the receptacle 12. Instead of using the arrangement of detents and recesses, the receptacle 12 and the base 18 may be formed to be so nearly the same size that pressing them together creates sufficient frictional force to retain them in engagement. Other structures, such as a peripheral ring (not shown) and a corresponding groove (not shown) that snap fit together for holding the receptacle 12 and the base 18 in engagement are also satisfactory means for fastening the receptacle 12 and base 18 together.

Referring to FIG. 1, the top 22 of the receptacle 12 is preferably tapered in the formed of a polyhedron as shown in the drawings or as a frustocone (not shown). The polyhedral top 22 preferably has a square or rectangular base to connect with the upper edges 31 of the sides 32 of the rectangular receptacle 12. The polyhedral top 22 has its largest cross section at the juncture of the top 22 with the upper edges 31 of the receptacle 12. The dispensing section 14 includes an opening 28 in the top 26 of the receptacle 12. In the plane of the opening 28, the cross section of the top 22 is preferably slightly larger than the area of the opening 28. The tapered shape of the top of the receptacle assists in guiding the paper to the opening while preventing the paper from snagging, which could cause undesired tearing of the paper inside the receptacle 12.

Figure 7:
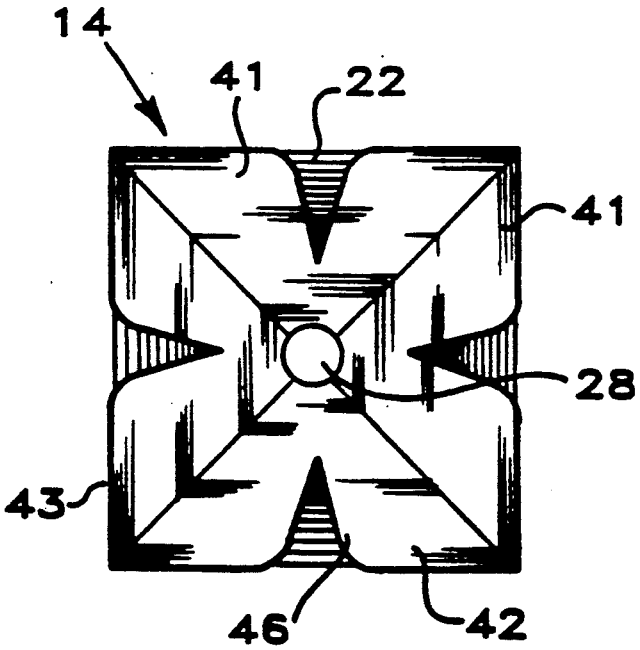
FIG. 7 is a top plan view of the tissue paper dispenser of FIGS. 1 and 2.

The dispensing section 14 further includes a paper tearing section 34. Referring to FIGS. 1, 2, 4 and 5, the paper tearing sections 34 may be formed as a polyhedron that is inverted with respect to the top 22 of the receptacle 12. FIGS. 1, 2 and 7 show the paper tearing section 34 to be formed from four substantially identical, generally triangular plates 40–43. The opening 28 is formed where the four vertices of the triangular plates 40–43 would meet at the center of the paper tearing section 34.

Referring to FIGS. 1, 2 and 5, the paper tearing section 34 includes at least one tearing slot 46 formed in an outer edge of one of the triangular plates, the plate 40 for example. The tearing slot 46 is spaced apart from the opening 28. This distance between the inner edge of the slot 46 and the edge of the opening 28 is not critical to practicing the invention. However, in presently preferred embodiments the distance is ranges from about one inch to about three inches.

To dispense paper from the tissue paper dispenser 10, the user pulls on the free end 48 until the desired length of paper extends beyond the slot 46. The user then pulls the paper into engagement with the edges of the slot and continues to pull the paper toward the bottom of the slot until the paper tears. It is not necessary to align perforations in the paper with the edges of the slot in order tear the paper off in the slot. The paper has a tendency to tear at the perforations, but it will also tear at other places in the roll depending upon where the user grasps the paper and where the slot engages the roll.

Having the slot 46 spaced away from the opening prevents the weight of the paper from pulling the free end of the paper into the receptacle 12. If the paper is torn at the edge of the opening 28 as in some prior art devices, then the free end of the roll can fall into the receptacle 12 unless a retainer is used to hold the paper.

The tearing slots are preferably arranged around the edges of the paper tearing section 34 so that there is at least one tearing slot on each side of the paper tearing section 34. The free end 48 of the roll of tissue paper 16 is passed through the hole 28 in the center of the top 22 of the receptacle 12.

Instead of being polyhedral, the paper tearing section 34 may be a truncated cone (not shown) or other convenient shape. Referring to FIG. 3, there is shown a rolled paper dispenser 50 formed generally as a rectangular box having sides 52. The sides 52 of the rolled paper dispenser 50 have upwardly extending edges that have a plurality of paper tearing slots 54 formed therein. The paper tearing slots 54 may be formed anywhere in the edges, including the corners.

The tissue paper dispenser 10 is preferably formed of an inexpensive plastic by well-known molding techniques. The tissue paper dispenser 10 may also be formed of other materials, such as metal or wood.

Referring to FIGS. 4–7, the tissue paper dispenser 10 may include a plurality of pads 60 attached to the bottom 62 of the base 18. The pads 60 may be formed of felt or the like and serve to prevent the base 18 from scratching surfaces such as table tops upon which the tissue paper dispenser 10 may be placed for convenient use.

Referring to FIG. 8, a tissue dispenser 99 according to the present invention comprises a hollow box 100 that is similar in shape to the receptacle 12. A length of rolled paper 101 extends from a hole 102 in a first side 104 of the box 100. A post 106 is formed on a second side 108. The post 106 may be any convenient shape. As shown in FIG. 8, the post 106 may advantageously be formed as a frustocone with the smaller end mounted to the surface of the box 100. The paper may be wrapped around the post 106 near its connection with the box. The paper may be torn by pulling on it. After the paper is torn, it remains wrapped around the post 106, which prevent the end of the rolled paper from falling back into the box.

Referring to FIG. 9, a tissue dispenser 109 according to the present invention comprises a hollow box 110 that is similar in shape to the box 100. A length of rolled paper 112 extends from a hole 114 in a side 116 of the box 100. Posts 118–121 extend from the side 116 of the box 110. The length of paper may be torn by wrapping it at least partially around one or more of the posts 118–121.

Referring to FIG. 10, a tissue dispenser 129 according to the present invention comprises a hollow box 130 having a hole 132 in a side 134 thereof. A hook 136 is formed on a side 138 of the box 130. A length of rolled paper 140 extends from the hole 132 and wraps around the hook 136. The paper is torn by engaging it with the hook and pulling on the end of the length of paper 140.

All of the embodiments of the invention described herein have the advantage of having the paper torn at a location spaced apart from the opening in the box or receptacle in which the roll of paper is stored, which prevents the end of the paper from falling into the opening after a length of paper is torn from the roll. The structures illustrated and described herein illustrate the principles of the present invention. Modifications to the illustrated embodiments may be made without departing from the spirit of the present invention. Therefore the present invention includes the subject matter defined by the appended claims and all reasonable equivalents.

What is claimed is:

1. A rolled paper dispenser, comprising:

a receptacle configured to hold a roll of paper, the receptacle including a base, side walls and a top, the top having an opening formed therein so that the free end of the roll of paper may extend out of the receptacle; and a dispensing section connected to the receptacle, the dispensing section including:

means for guiding the paper toward the opening in the top of the receptacle; and paper tearing means including a tapered section formed in the top of the receptacle, extensions of the side walls of the receptacle and a plurality of slots formed in the extensions of the sides spaced apart from the opening so that a user may engage the paper in one of the slots to tear off a selected length of the paper from the roll.

* * * * *